US010804052B1

(12) United States Patent
Wilkins

(10) Patent No.: US 10,804,052 B1
(45) Date of Patent: Oct. 13, 2020

(54) SWITCH ASSEMBLY HAVING IGNITION-RESISTANT CHARACTERISTICS

(71) Applicant: Wilkins IP, LLC, New Albany, IN (US)

(72) Inventor: Larry C. Wilkins, Ft. Lauderdale, FL (US)

(73) Assignee: Electromechanical Research Laboratories, Inc., New Albany, IN (US)

( * ) Notice: Subject to any disclaimer, the term of this patent is extended or adjusted under 35 U.S.C. 154(b) by 0 days.

(21) Appl. No.: 16/586,120

(22) Filed: Sep. 27, 2019

(51) Int. Cl.
*G08B 7/06* (2006.01)
*H01H 19/14* (2006.01)
*H01H 19/62* (2006.01)

(52) U.S. Cl.
CPC ..... *H01H 19/14* (2013.01); *G08B 7/06* (2013.01); *H01H 19/62* (2013.01)

(58) Field of Classification Search
CPC ..... G09G 2300/0819; G09G 2320/043; G09G 3/3233; G09G 2300/0842; G09G 2300/0861; G09G 2310/0251; G09G 2310/0262; G09G 2300/0852; G09G 2300/0866; G09G 2320/0223; G09G 2320/045; G09G 2330/04; H01L 2029/7863; H01L 27/1225; H01L 27/124; H01L 27/1255; H01L 29/78621; H01L 41/00; H01L 41/1134; H01L 41/1136; G01R 33/028; G01R 33/0286; G01R 33/038; G01R 33/093; H01H 59/00; H01H 13/14; H01H 13/183; H01H 23/168; H01H 23/28; H01H 29/22; H02N 10/00; H02N 2/18; H02N 2/181; H02N 2/186; Y10T 307/826; Y10T 137/7368; Y10T 137/7781; Y10T 156/1092; Y10T 16/538; Y10T 16/549; Y10T 29/5124; Y10T 29/5196; Y10T 307/461; Y10T 477/814; Y10T 70/7068; Y10T 74/1221; Y10T 83/6526;

(Continued)

(56) References Cited

U.S. PATENT DOCUMENTS 4,994,787 A * 2/1991 Kratt ..... G08B 25/10 340/505
5,027,391 A * 6/1991 O'Neill ..... H04M 1/723 379/157

(Continued)

*Primary Examiner* — Daniel Previl
(74) *Attorney, Agent, or Firm* — Womble Bond Dickinson (US) LLP

(57) ABSTRACT

A switch assembly for electrically coupling and uncoupling a first device to a second device may include a first switch configured to electrically couple and uncouple a first device to the second device, and a first switching barrel. The switch assembly may further include a second switch configured to electrically couple and uncouple a power source to the second device, and a second switching barrel. The switch assembly may also include an isolator barrier separating the first and second switches from one another and the first and second switching barrels from one another. The switch assembly may further include a shaft associated with the first and second switching barrels, such that rotation of the shaft causes angular displacement of the first and second switching barrels, electrically coupling or uncoupling of the first device to the second device, and electrically coupling or uncoupling of the power source to the second device.

20 Claims, 8 Drawing Sheets

(58) Field of Classification Search
CPC ..... A47L 15/4259; A62C 37/08; B25F 1/04; B26B 11/001; B26B 11/008; B27B 29/10; B41L 19/00; B41L 45/00; B60K 31/00; B60K 31/18; B60T 8/74; B60Y 2200/11; B60Y 2200/12; B60Y 2200/126; B60Y 2200/13; B60Y 2200/30; B60Y 2200/40; B60Y 2200/50; B60Y 2200/90; B62D 5/065; E02F 5/32; E02F 9/2029; F02B 75/16; F02P 1/00; F02P 1/086; F02P 5/1553; F03G 3/00; F21L 2/00; F21L 4/00; F21V 33/00; F21V 33/0084; G01C 21/00; G01F 1/125; G01J 1/24; G03B 7/003; G03B 7/085; G03B 9/07; G05B 19/41815; G05B 19/427; G05B 2219/33088; G05B 2219/35269; G05B 2219/35373; G05B 2219/35534; G05B 2219/36366; G05B 2219/36368; G05B 2219/43194; G05B 2219/45213; G05B 2219/50249; G05B 2219/50295; G05B 2219/50334; G05D 1/0202; G05D 23/1912; G05D 23/275; G05D 3/1472; G05D 9/12; G06Q 2240/00; G07B 3/02; G07C 5/008; G07C 9/0069; G08G 1/00; H01Q 1/421; H01R 4/00; H01R 4/48; H01R 9/16; H02K 7/025; H02K 7/1004; H02K 7/108; H02K 7/116; H02P 23/16; H02P 7/03; H04L 67/12; Y02P 90/08; Y02T 10/46; Y04S 40/18
USPC .... 340/326, 331, 539.1, 425.5, 332, 815.45, 340/815.47, 815.69, 815.9
See application file for complete search history.

(56) References Cited

U.S. PATENT DOCUMENTS 5,185,786 A * 2/1993 Zwick ..... H04M 3/36 379/207.03
5,360,426 A * 11/1994 Muller ..... A61B 18/22 606/13
5,402,421 A * 3/1995 Hayasaka ..... G06F 13/364 370/439
5,423,006 A * 6/1995 Brown ..... G06F 13/4022 370/426
5,673,030 A * 9/1997 Kosich ..... G08B 5/38 340/635
5,715,237 A * 2/1998 Akiyoshi ..... H04L 49/254 370/228

* cited by examiner

SWITCH ASSEMBLY HAVING IGNITION-RESISTANT CHARACTERISTICS

TECHNICAL FIELD

The present disclosure relates to a switch assembly, and more particularly, to a switch assembly having ignition-resistant characteristics.

BACKGROUND

Some environments have characteristics rendering them susceptible to ignition of a fire or an explosion. For example, some environments may include flammable gases, flammable vapors, combustible vapors, combustible dusts, and/or ignitable fibers present in the air in quantities sufficient to produce ignitable mixtures. In such environments, a small spark, electrical arc, and/or high temperatures may be sufficient to initiate a fire or explosion. Thus, it may be desirable to provide a switch assembly having characteristics that reduce the likelihood of initiating a fire or explosion under such circumstances. The assemblies and methods disclosed herein may be directed to addressing one or more of these possible events.

SUMMARY

According to a first aspect, a switch assembly for electrically coupling a first electrical device to, and electrically uncoupling the first electrical device from, a second electrical device may include a first switch configured to electrically couple the first electrical device to, and electrically uncouple the first electrical device from, a second electrical device, and a first switching barrel associated with the first switch and configured to cause the first switch to electrically couple the first electrical device to, and electrically uncouple the first electrical device from, the second electrical device. The switch assembly may further include a second switch configured to electrically couple a power source to, and electrically uncouple the power source from, the second electrical device, and a second switching barrel associated with the second switch and configured to cause the second switch to electrically couple the power source to, and electrically uncouple the power source from, the second electrical device. The switch assembly may also include an isolator barrier separating the first switch and the first switching barrel from the second switch and the second switching barrel. The switch assembly may further include a shaft associated with the first switching barrel and associated with the second switching barrel, such that rotation of the shaft causes angular displacement of the first switching barrel and the second switching barrel, electrically coupling the first electrical device to the second electrical device or electrically uncoupling the first electrical device from the second electrical device, and electrically coupling the power source to the second electrical device or electrically uncoupling the power source from the second electrical device.

According to a further aspect, a notification cabinet may include an enclosure defining an interior volume and a notification panel associated with the enclosure and configured to provide a visual notification and/or an audible notification. The notification panel may further include a switch assembly for electrically coupling a sensor to, and electrically uncoupling the sensor from, the notification panel. The switch assembly may also include a first switch configured to electrically couple the sensor to, and electrically uncouple the sensor from, the notification panel, and a first switching barrel associated with the first switch and configured to cause the first switch to electrically couple the sensor to, and electrically uncouple the sensor from, the notification panel. The switch assembly may also include a second switch configured to electrically couple a power source to, and electrically uncouple the power source from, the notification panel, and a second switching barrel associated with the second switch and configured to cause the second switch to electrically couple the power source to, and electrically uncouple the power source from, the notification panel. The switch assembly may further include an isolator barrier separating the first switch and the first switching barrel from the second switch and the second switching barrel. The switch assembly may also include a shaft associated with the first switching barrel and associated with the second switching barrel, such that rotation of the shaft causes angular displacement of the first switching barrel and the second switching barrel, electrically coupling the sensor to the notification panel or electrically uncoupling the sensor from the notification panel, and electrically coupling the power source to the notification panel or electrically uncoupling the power source from the notification panel.

According to another aspect, a notification system for providing a visual notification associated with a level of cargo in a cargo compartment and/or an audible notification associated with the level of the cargo in the cargo compartment, may include a sensor configured to generate a signal indicative of a level of cargo in a cargo compartment, and a notification panel configured to provide at least one of a visual notification or an audible notification. The notification system may further include a switch assembly for electrically coupling the sensor to, and electrically uncoupling the sensor from, the notification panel. The switch assembly may include a first switch configured to electrically couple the sensor to, and electrically uncouple the sensor from, the notification panel, and a first switching barrel associated with the first switch and configured to cause the first switch to electrically couple the sensor to, and electrically uncouple the sensor from, the notification panel. The switch assembly may also include a second switch configured to electrically couple a power source to, and electrically uncouple the power source from, the notification panel, and a second switching barrel associated with the second switch and configured to cause the second switch to electrically couple the power source to, and electrically uncouple the power source from, the notification panel. The switch assembly may further include an isolator barrier separating the first switch and the first switching barrel from the second switch and the second switching barrel. The switch assembly may also include a shaft associated with the first switching barrel and associated with the second switching barrel, such that rotation of the shaft causes angular displacement of the first switching barrel and the second switching barrel, electrically coupling the sensor to the notification panel or electrically uncoupling the sensor from the notification panel, and electrically coupling the power source to the notification panel or electrically uncoupling the power source from the notification panel.

BRIEF DESCRIPTION OF THE DRAWINGS

The detailed description is described with reference to the accompanying figures. In the figures, the same reference numbers in different figures indicate similar or identical items.

DETAILED DESCRIPTION

Figure 1:
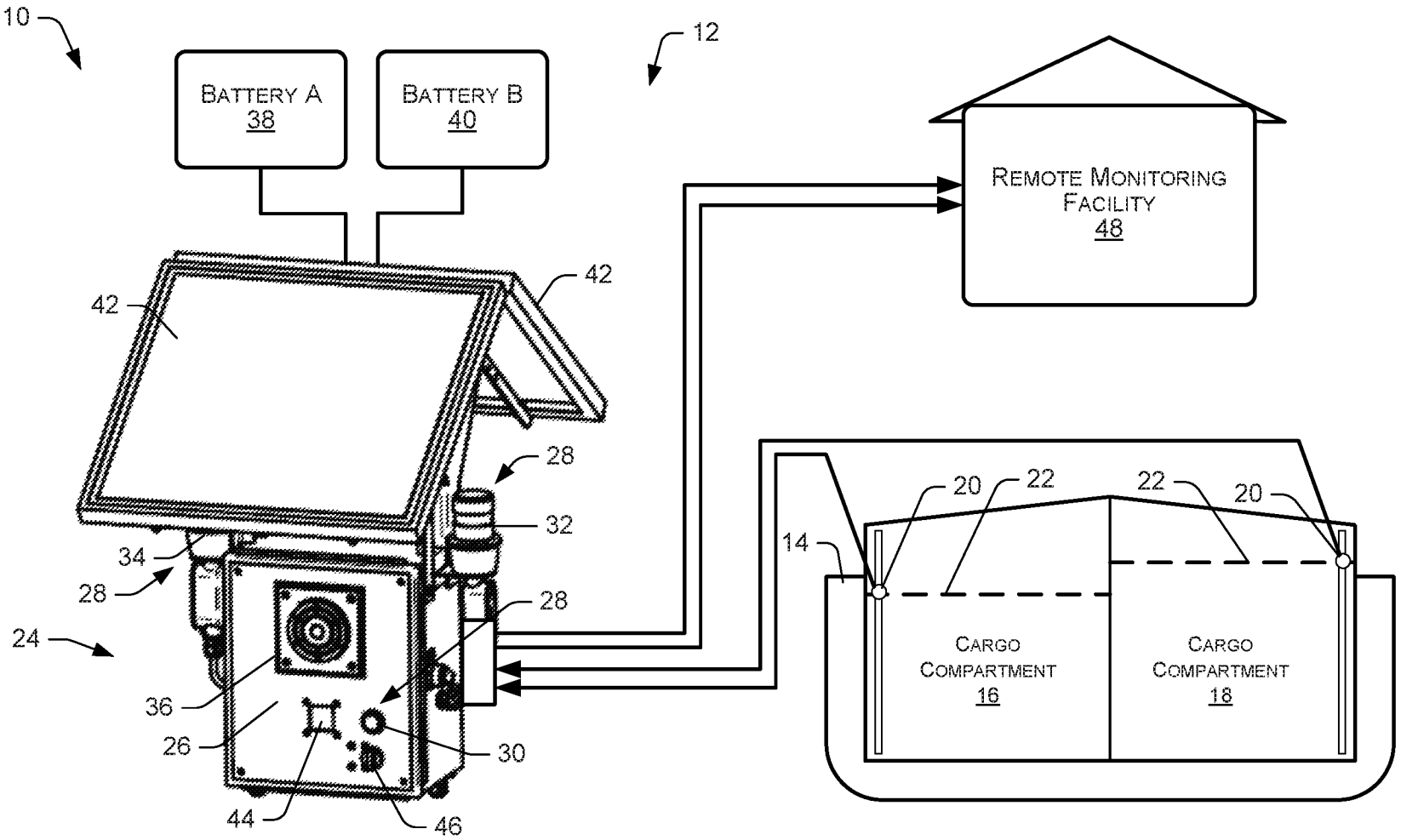
FIG. 1 is a schematic perspective view showing an example environment and an example notification system associated with the example environment.

FIG. 1 shows an example environment 10 including a schematic perspective view of an example notification system 12 for providing a notification associated with a condition related the environment 10. For example, the notification system 12 may be used for providing a visual notification associated with a level of cargo in a cargo compartment and/or an audible notification associated with the level of the cargo in the cargo compartment. For example, the cargo compartment may be a cargo compartment in a barge configured to hold and transport a commodity (e.g., a liquid and/or a solid) from a first geographic location to a second geographic location, for example, via a waterway, such as an ocean, a bay, a lake, a river, and/or a canal. Other types of environments are contemplated. For example, as shown in FIG. 1, an example barge 14 includes a first example cargo compartment 16 and a second example cargo compartment 18, each for containing an example commodity, which may be the same or different. Although FIG. 1 shows two cargo compartments 16 and 18, fewer or more cargo compartments are contemplated.

As shown in FIG. 1, the example notification system 12 includes a plurality of sensors 20, each configured to generate a signal indicative of a cargo level 22 of cargo in each of the cargo compartments 16 and 18. One or more sensors 20 may be provided in each cargo compartment. Although FIG. 1 shows an example barge 14, other types of cargo carriers are contemplated, such as, for example, other ground-borne, air-borne, or water-borne vehicles or carriers. In some examples, the one or more sensors 20 may include a load level sensor, which may include, for example, one or more floats and/or one or more reed switches. Other types of sensors 20 are contemplated. In some examples, one or more of the sensors 20 may be ignition-resistant (e.g., intrinsically safe), such that they may be used in environments characterized by fire and/or explosion hazards, such as environments including flammable gases, flammable vapors, combustible vapors, combustible dusts, and/or ignitable fibers present in the air in quantities sufficient to produce ignitable mixtures. For example, the sensors 20 may be designed to reduce the likelihood or prevent a spark or temperatures sufficient to ignite such mixtures. Some examples of the sensors 20 may be certified as intrinsically safe by, for example, Underwriters Laboratories (UL), FM Approvals, F2 Labs, and/or other recognized certification organizations, either government-based or non-government-based. As shown, the example notification system 12 also includes a notification cabinet 24 configured to provide a visual notification and/or an audible notification of the cargo level 22 in one or more of the cargo compartments 16 and 18. Each of the sensors 20 may be in communication with the notification cabinet 24, for example, via a hard-wired connection and/or via a wireless transmission protocol.

As shown in FIG. 1, the example notification cabinet 24 includes a notification panel 26 configured to provide a visual notification and/or an audible notification of the cargo level 22 in one or more of the cargo compartments. For example, the notification panel 26 may include one or more visual notification devices 28 configured to provide a visual notification of the cargo level 22 in one or more of the cargo compartments 16 or 18. In some examples, the visual notification devices 28 may include any type of light or display configured to illuminate or display according to a strategy that provides an indication of the cargo level 22. For example, the visual notification device 28 may include one or more lights that change color, blink, change messages, and/or change intensity with a change in the cargo level 22. In some examples, the visual notification devices 28 may include more than one light, and the more than one light may be illuminated to provide an indication of the change in cargo level 22. For example, illumination of an amber light may indicate that the cargo level 22 is approaching a full condition (e.g., approaching 95% full), and illumination of a red light may indicate that the cargo level 22 is full or over-full condition (e.g., at 98% full or greater). For example, as shown in FIG. 1, the notification cabinet 24 includes a green notification light 30, for example, configured to indicate that the cargo level 22 in one or more of the cargo compartments is less than full, an amber notification light 32 (partially shown), for example, to indicate that the cargo level 22 in one or more of the cargo compartments is approaching a full condition, and a red notification light 34 (partially obscured in FIG. 1), for example, configured to indicate that the cargo level 22 in one or more of the cargo compartments is at a full condition or is in an over-full condition. In some examples, the one or more visual notification devices 28 may be provided for each cargo compartment of a cargo carrier, for example, so that the notification panel 26 may provide an indication of the cargo level 22 in each of the cargo compartments.

As shown in FIG. 1, some examples of the notification cabinet 24 (e.g., the notification panel 26) may include an audible notification device 36 configured to provide an audible notification of the cargo level 22 in one or more of the cargo compartments. In some examples, the audible notification device 36 may include any type of sound generating device, such as, for example, a buzzer, an alarm, a bell, and/or a speaker configured to generate sound according to a sound-making strategy that provides an audible indication of the cargo level 22. For example, the audible notification device 36 may include an alarm or buzzer that changes volume, sound pattern, and/or pitch with a change in the cargo level 22. In some examples, the audible notification device 36 may include more than one sound generating devices, and the more than one sound generating devices may generate different sounds to provide an indication of the change in cargo level 22. For example, a buzzer may be activated to indicate that the cargo level 22 is approaching a full condition (e.g., approaching 95% full), and an alarm may be activated to indicate that the cargo level 22 is at a full condition or an over-full condition (e.g., at 98% full or greater). In some examples, the audible indication device 36 may be provided for each cargo compartment of a cargo carrier, for example, so that the notification panel 26 may provide an indication of the cargo level 22 in each of the cargo compartments.

The notification cabinet 24, in some examples, may include an electric power source for providing electric power to electric components of the notification cabinet 24. For example, as shown in FIG. 1, the example notification cabinet 24 may be selectively electrically coupled to one or more batteries, such as, for example, a Battery A 38 and a Battery B 40, as shown in FIG. 1. Some examples may include one or more solar panels 42 configured to convert sunlight into electrical power, which may be stored by the notification cabinet 24, for example, by the one or more batteries, which provide a power source for operation of the notification cabinet 24. Other types of power sources are contemplated, in addition to and/or as an alternative to, solar power. As shown in FIG. 1, the notification cabinet 24 may include a voltmeter 44 configured to provide an indication of an operational status of the notification cabinet 24, such as, for example, the charge level of the one or more Batteries A 38 and/or B 40.

Figure 2:
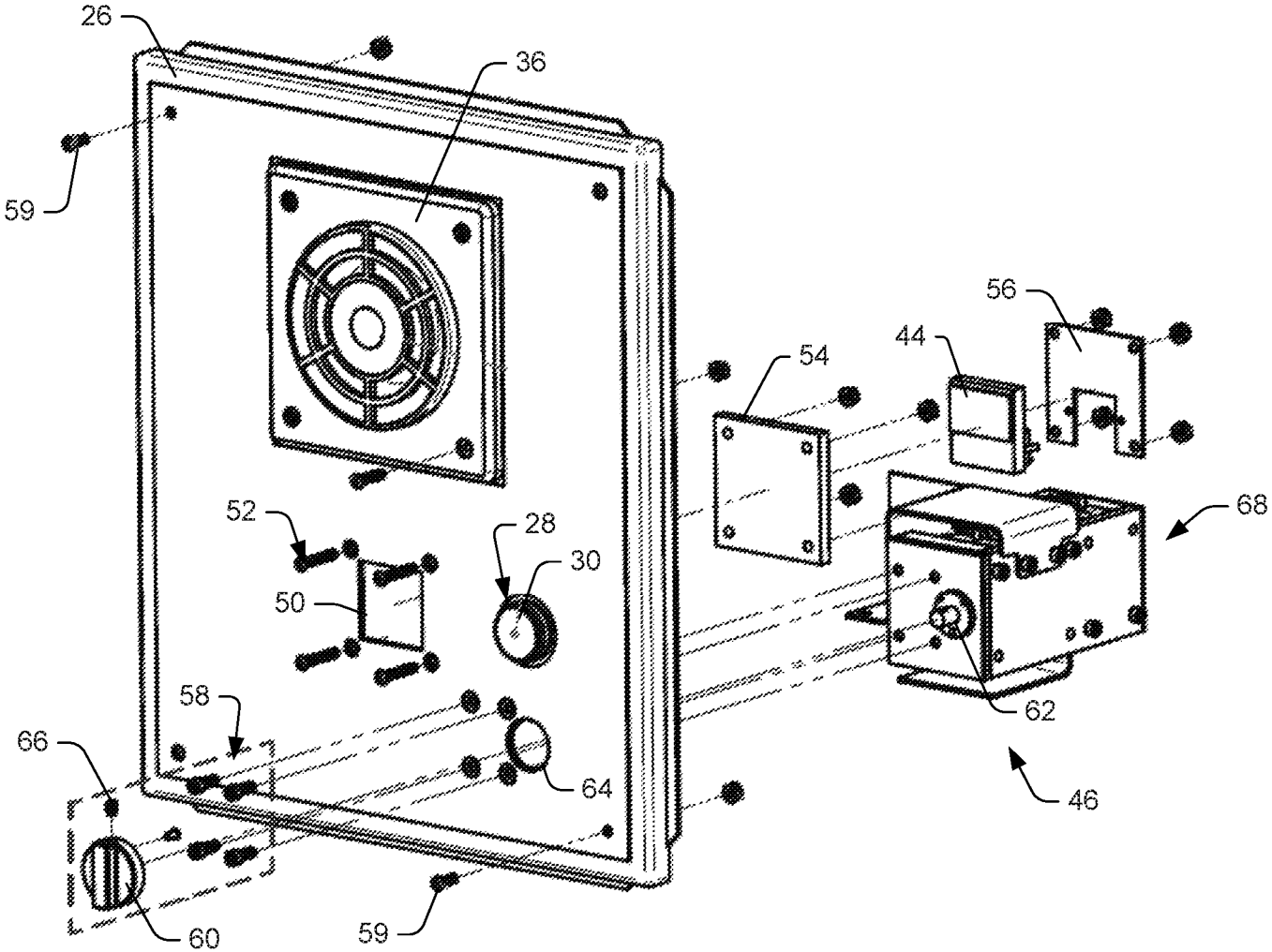
FIG. 2 is a schematic assembly view of an example notification panel and an example switch assembly.

As shown in FIGS. 1 and 2, the notification cabinet 24 may include a switch assembly 46, for example, configured to activate and deactivate the notification cabinet 24 and/or to switch between power sources (e.g., to switch between Battery A 38 and Battery B 40 as a power source) for supplying electrical power to the one or more visual notification devices 28, the one or more audible notification devices 36, and/or any other electrically powered components of the notification system 12. For example, the switch assembly 46 may be configured to act as a bypass switch assembly configured to facilitate selection between operating modes of the notification cabinet 24. In some examples, the switch assembly 46 may be configured to deactivate one or more of the visual notification devices 28 and/or one or more of the audible notification devices 36 of the notification cabinet 24 (e.g., all of the visual and audible notification devices associated with the notification cabinet 24). In some such examples, the switch assembly 46 may be configured to electrically connect the one of more sensors 20 to a system remote from the notification cabinet 24, for example, so that a person and/or electronic controller receives the sensor signals (e.g., a remotely-located notification panel), for example, at a remote monitoring facility 48, such as a dock facility associated with a location for loading cargo compartments. For example, a person located at the remote monitoring facility 48 located remotely from the cargo carrier may monitor loading of the cargo carrier via a user interface that receives the sensor signals from the one or more sensors 20. In some examples, this may permit remote monitoring, for example, when the notification cabinet 24 is not working properly due, for example, to lack of power and/or malfunctioning (e.g., the one or more batteries lack sufficient charge to operate the visual notification devices and/or the audible notification devices).

Although the example switch assembly 46 is shown as part of the example notification cabinet 24 for the purpose of describing an example use, other uses for the example switch assembly 46 are contemplated. For example, one or more features consistent with the example switch assembly 46 may be used in association with any device for which it might be beneficial and/or desirable to provide an at least partially intrinsically-safe switch assembly, such as, for example, any environment characterized by fire and/or explosion hazards, such as environments including flammable gases, flammable vapors, combustible vapors, combustible dusts, and/or ignitable fibers present in the air in quantities sufficient to produce ignitable mixtures, and/or in any environments for which intrinsically-safe characteristics are required by a regulatory body, such as non-government-based regulatory bodies (e.g., industry-based regulatory bodies) and/or government-based regulatory bodies.

As shown in FIG. 2, some examples of the notification panel 26 include an aperture 50 for facilitating viewing of the voltmeter 44. For example, the voltmeter 44 may be mounted to an interior side of the notification panel 26, for example, via one or more fasteners 52 (e.g., nuts and bolts), at a location corresponding to the aperture 50. In some examples, a transparent panel 54 may be provided between the voltmeter 44 and the interior side of the notification panel 26, and/or a mounting plate 56 may be provided on the interior side of the voltmeter 44 to facilitate coupling the voltmeter 44 to the notification panel 26.

As shown in the example of FIG. 2, the switch assembly 46 may be coupled to the notification panel 26 (e.g., to the interior side of the notification panel 26) via one or more fasteners 58 (e.g., bolts), and the notification panel 26, in at least some examples, may be coupled to the remainder of the notification cabinet 24 via, for example, one or more fasteners 59 (e.g., screws and/or nuts and bolts). For example, as shown, the example switch assembly 46 includes a selector knob 60 and a selector shaft 62, with the selector shaft 62, when assembled to the notification panel 26, extending through an aperture 64 in the notification panel 26. The selector knob 60 may be coupled to the selector shaft 62, for example, via a set screw 66, such that the selector knob 60 is accessible from the exterior of notification cabinet 24 and the remainder of the switch assembly 46 is housed within the interior of the notification cabinet 24. In some examples, the selector shaft 62 may include or be formed from fiber reinforced polymer, such as, for example, aramid reinforced polyamide (e.g., a material marketed under the tradename, HYDLAR Z®), although other suitable materials are contemplated.

Figure 3:
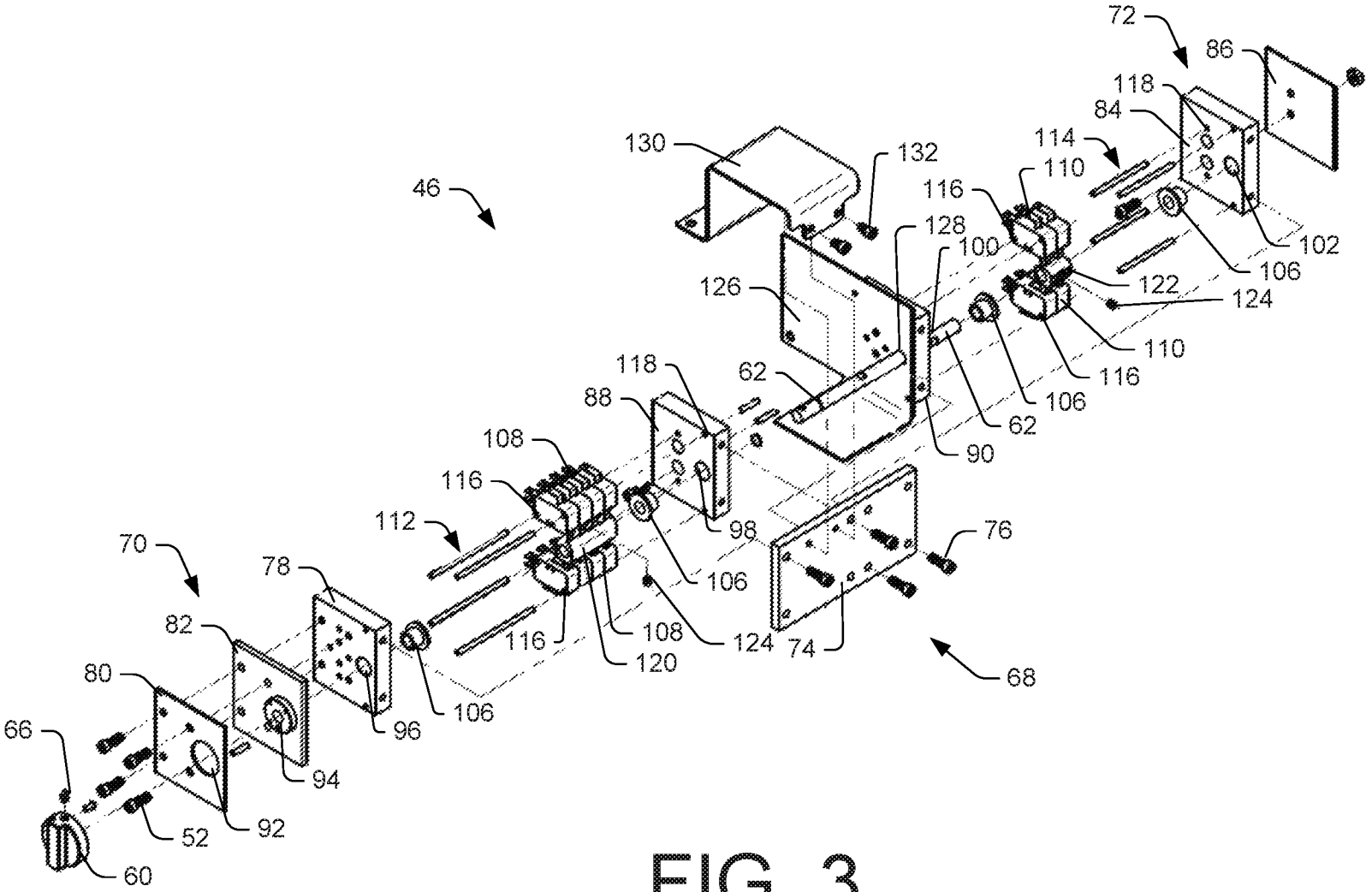
FIG. 3 is a schematic assembly view of an example switch assembly.

As shown in FIG. 3, some examples of the switch assembly 46 include a support assembly 68 configured to support at least a portion of the switch assembly components. For example, the switch assembly 46 shown in FIG. 3 includes a first support end 70 configured abut against the interior surface of the notification panel 26 (see FIG. 2), an opposite second support end 72 spaced from the first support end 70 by a side support 74 extending between the first support end 70 and the second support end 72. In some examples, the first support end 70 and the side support 74 may be coupled to one another via fasteners 76 (e.g., bolts), and the side support 74 and the second support end 72 may be coupled to one another by the fasteners 76, for example, as shown in FIG. 3.

In some examples, the first support end 70 may include a first support plate 78 and a gasket 80 configured to seal the exterior surface of the notification panel 26 from the interior of the notification panel 26 at the aperture 64 through which the selector shaft 62 extends (see FIG. 2). In some examples, the first support end 70 may also include a bushing plate 82 through which the selector shaft 62 extends, and the bushing plate 82 may be positioned between the first support plate 78 and the gasket 80. In some examples, the second support end 72 includes a second support plate 84 and a backing plate 86 configured to abut one another, for example, in a face-to-face manner. In the example shown in FIG. 3, the support assembly 68 also includes a first intermediate support 88 and a second intermediate support 90 coupled to the side support 74 via, for example, the fasteners 76.

In the example shown FIG. 3, each of the gasket 80, the bushing plate 82, the first support plate 78, the first intermediate support 88, the second intermediate support 90, and the second support plate 84 includes, respectively, an aperture 92, an aperture 94, an aperture 96, an aperture 98, an aperture 100, and an aperture 102. In some examples of the switch assembly 46, the aperture 96 in the first support plate 78, the aperture 98 in the first intermediate support 88, the aperture 100 in the second intermediate support 90, and/or the aperture 102 in the second support plate 84 may be configured to receive therein a bearing 106 (e.g., a flanged sleeve bearing), for example, as shown in FIG. 3. As explained herein, the selector shaft 62 may extend through the bearing(s) 106, such that the selector shaft 62 may rotate.

In the example shown in FIG. 3, the switch assembly 46 may also include a plurality of first electrical switches 108 (e.g., microswitches) and plurality of second electrical switches 110 (e.g., microswitches). For example, the first electrical switches 108 may be received in the support assembly 68 between the first support plate 78 and the first intermediate support 88, and the second electrical switches 110 may be received in the support assembly 68 between the second intermediate support 90 and the second support plate 84. Some examples may include a single first electrical switch 108 and/or a single second electrical switch 110. As shown in FIG. 3, the first electrical switches 108 are coupled to the support assembly 68 via a plurality of first pins 112, and the second electrical switches 110 are coupled to the support assembly 68 via a plurality of second pins 114. For example, the first electrical switches 108 and the second electrical switches 110 may each include one or more mounting holes 116 (see also FIGS. 7B, 7C, 8B, 8C, 9B, and 9C), through which the respective pins 108 and 110 extend, with the ends of the pins 108 and 110 being received in anchor holes 118 in the first support plate 78, the first intermediate support 88, the second intermediate support 90, and the second support plate 84.

As shown in FIG. 3, some examples of the switch assembly 46 include a first switching barrel 120 associated with one or more of the first electrical switches 108 and configured to cause the one or more first electrical switches 108 to electrically couple one or more of the sensors 20 to, and electrically uncouple the one or more sensors 20 from, the notification panel 26. The example switch assembly 46 shown in FIG. 3 also includes a second switching barrel 122 associated with one or more of the second electrical switches 110 and configured to cause the one or more second electrical switches 110 to electrically couple one or more power sources to, and electrically uncouple the one or more power sources from, the notification panel 26. For example, the one or more power sources may include one or more batteries (e.g., the Battery A 38 and/or the Battery B 40). In the example shown in FIG. 3, the first switching barrel 120 is coupled to the selector shaft 62 at a portion of the selector shaft 62 longitudinally aligned with the first electrical switches 108, and the second switching barrel 122 is coupled to the selector shaft 62 at a portion of the selector shaft 62 longitudinally aligned with the second electrical switches 110, for example, via respective set screws 124, as explained in more detail herein with respect to FIGS. 7A-9C. In some examples, and as explained in more detail with respect to FIGS. 7A-9C, rotation of selector shaft 62 (e.g., via the twisting of the selector knob 60) may cause angular displacement of the first switching barrel 120 and/or the second switching barrel 122, which may cause electrically coupling of one or more of the sensors 20 to the notification panel 26 and/or electrically uncoupling of the one or more sensors 20 from the notification panel 26. In some examples, angular displacement of the second switching barrel 122 may cause electrically coupling of a power source (e.g., one or more of the batteries) to the notification panel 26 or electrically uncoupling of the power source from the notification panel 26.

As shown in FIG. 3, the example switching assembly 46 may also include an isolator barrier 126 separating the first electrical switches 108 and the first switching barrel 120 from the second electrical switches 110 and the second switching barrel 122. In the example shown, the isolator barrier 126 includes an aperture 128 through which the selector shaft 62 extends between the first switching barrel 120 and the second switching barrel 122, and the isolator barrier 126 may be coupled to one or more of the first intermediate support 88 or the second intermediate support 90, for example, such that the isolator barrier 126 extends substantially perpendicular with respect to the selector shaft 62. In some examples, the isolator barrier 126 may serve to reduce the likelihood, or prevent, electrical arcs and/or electrical charge (e.g., static charge) from being transferred from the first electrical switches 108 to the second electrical switches 110 and/or from the second electrical switches 110 to the first electrical switches 108. For example, the isolator barrier 126 may at least partially result in the switch assembly 46 having ignition-resistant characteristics, for example, in the presence of flammable gases, flammable vapors, combustible vapors, combustible dusts, and/or ignitable fibers present in the air in quantities sufficient to produce ignitable mixtures. In some examples, the first electrical switches 108, the first switching barrel 120, the second electrical switches 110, the second switching barrel 122, and/or the isolator barrier 126 may at least partially provide an intrinsically safe electrical connection between the one or more sensors 20 and the notification panel 26, as certified by, for example, UL, FM Approvals, F2 Labs, and/or other recognized certification organizations, either government-based or non-government-based.

In some examples, the switch assembly 46 may provide a combination of intrinsically-safe characteristics and non-intrinsically-safe characteristics. For example, the isolator barrier 126 separating the first electrical switches 108 and the first switching barrel 120 from the second electrical switches 110 and the second switching barrel 122 may result in the portion of the switch assembly 46 associated with the first electrical switches 108 being intrinsically-safe and the portion of the switch assembly 46 associated with the second electrical switches 110 not necessarily being intrinsically-safe. For example, the portion of the switch assembly 46 associated with the second electrical switches 110 may not be intrinsically-safe, for example, under at least some conditions. In some examples, the isolator barrier 126 (e.g., either alone in or combination with other structural and/or electrical characteristics, such as, for example, the characteristics of the switches, the voltages and/or electrical currents associated with the inputs and outputs of the switches, etc.) may result in facilitating the combination of the intrinsically-safe characteristic of the portion of the switch assembly 46 including the first electrical switches 108 (e.g., on a first side of the isolator barrier 126), and the non-intrinsically-safe characteristic of the portion of the switch assembly 46 including the second electrical switches 110 (e.g., on a second side of the isolator barrier 126 opposite the first side of the isolator barrier 126).

In some examples, the voltage associated with one or more connections of the intrinsically-safe portion of the switch assembly 46 may not exceed, for example, 25 volts (e.g., 20 volts, 17.5 volts, 15 volts, 12.5 volts, 10 volts, 7.5 volts, 5 volts, or 2.5 volts), and/or the current associated with one or more connections of the intrinsically-safe portion of the switch assembly 46 may not exceed, for example, 200 milliamperes (ma) (e.g., 175 ma, 150 ma, 125 ma, 100 ma, 75 ma, 50 ma, or 25 ma). For example, the portion of the switch assembly 46 having intrinsically-safe characteristics may be configured such that one or more connections associated with the portion are unable to exhibit sufficient voltage and/or sufficient current to generate a spark sufficient to ignite a flammable and/or combustible mixture of components. In some examples, this may be characterized by a lack of electrical relays and/or electrical storage devices, such as, for example, batteries and/or devices having capacitive and/or indictive storage capability.

As shown in FIG. 3, some examples of the switching assembly 46 may include a ground plate 130 coupled to side support 74 via, for example, one or more fasteners 132 (e.g., bolts) and/or another portion of the notification cabinet 24. The ground plate 130 may serve to electrically ground the switching assembly 46.

Figure 4:
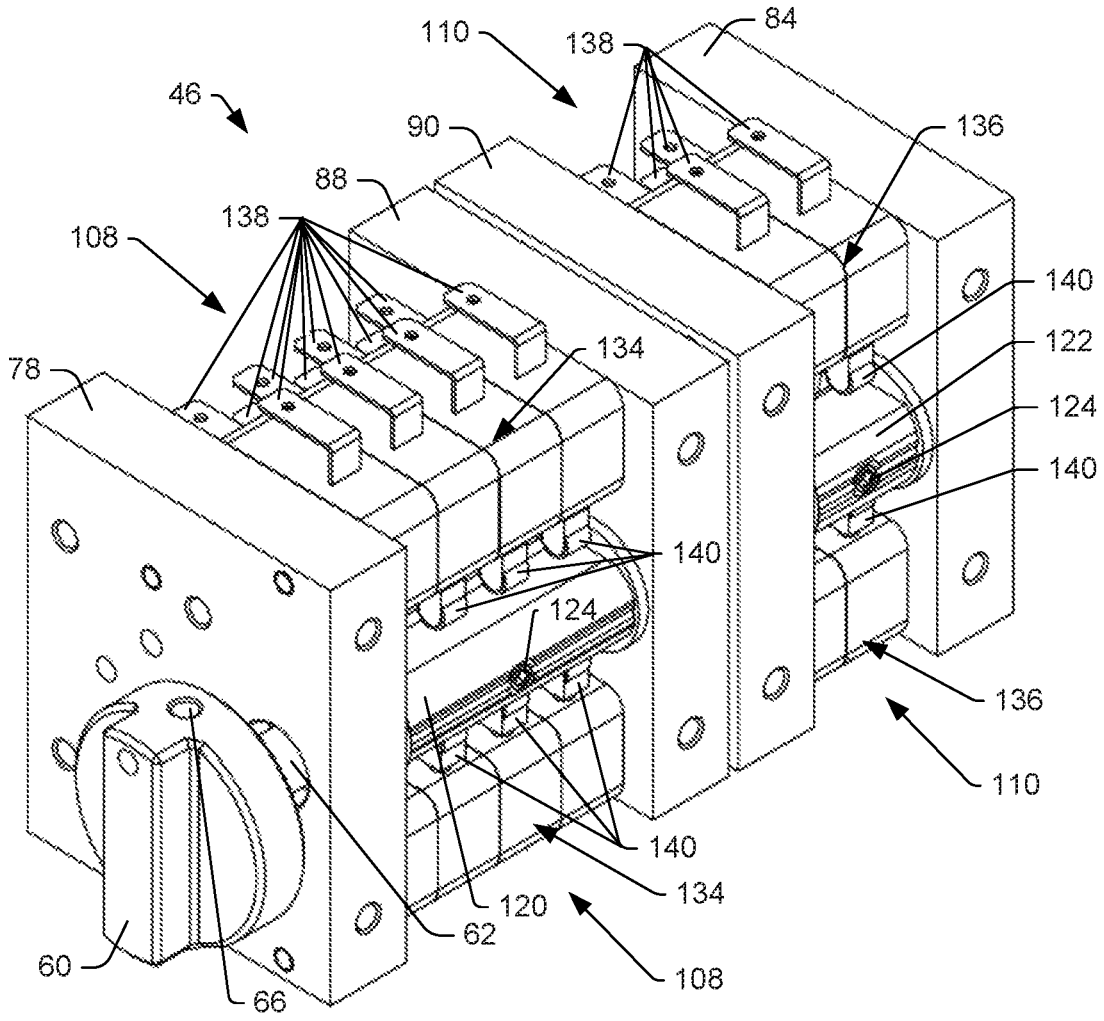
FIG. 4 is a schematic perspective view of portions of an example switch assembly.
Figure 5:
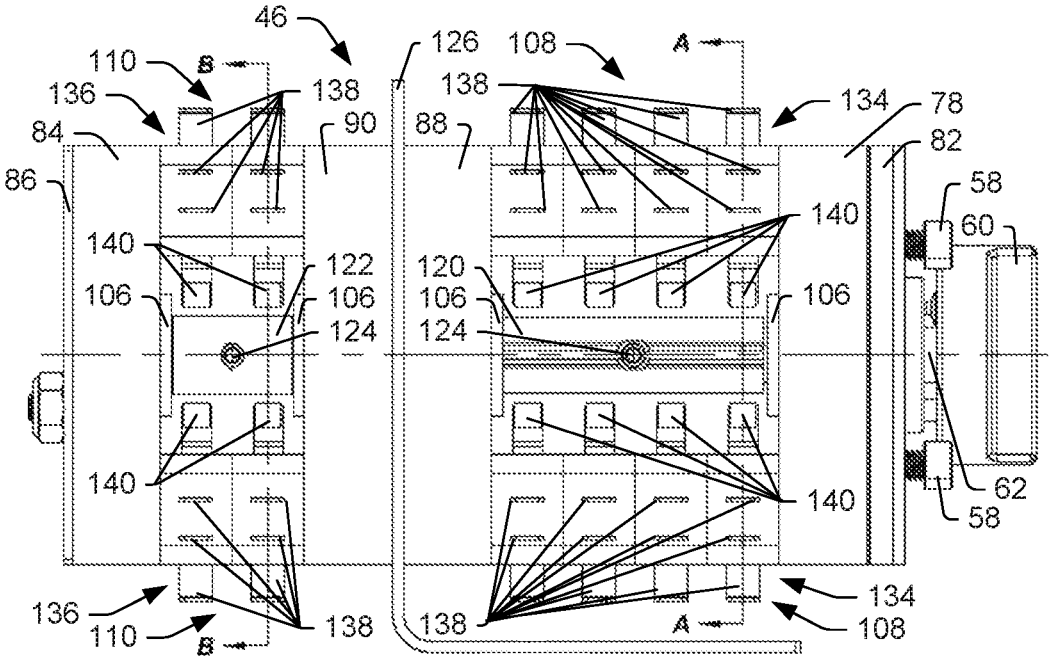
FIG. 5 is a schematic side view of the example switch assembly shown in FIG. 4.
Figure 6:
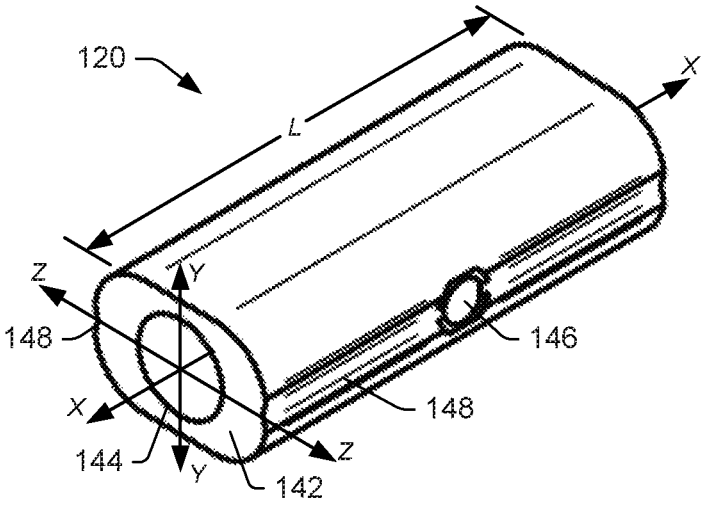
FIG. 6 is a schematic perspective view of an example switching barrel.

As shown in FIGS. 4-6, some examples of the switching assembly 46 may include a plurality of first electrical switches 108 and a plurality of second electrical switches 110. For example, the example switch assembly 46 shown in FIGS. 4-6 includes eight first electrical switches 108 arranged in two rows 134, each including four first electrical switches 108 coupled to switch assembly 46 by the first pins 112, for example, as shown in FIG. 3. The example switch assembly 46 shown in FIGS. 4-6 also includes four second electrical switches 110 arranged in two rows 136, each including two second electrical switches 110 coupled to the switch assembly 46 by the second pins 114, for example, as shown in FIG. 3. Arranged in this example manner, each of the rows 134 of the first electrical switches 108 may be substantially simultaneously and/or concurrently activated or deactivated by rotation and/or angular displacement of the first switching barrel 120, which is coupled to the selector shaft 62 and the selector knob 60. This, in turn, electrically couples the one or more sensors 20 to, or electrically uncouples the one or more sensors 20 from, the notification panel 26 (e.g., the four sensors 20 coupled to each row 134 of the first electrical switches 108). In some examples, this may also serve to electrically couple the one or more sensors 20 to, or electrically uncouple the one or more sensors 20 from, the remote monitoring facility 48 (see FIG. 1). In some examples, each of the rows 136 of the second electrical switches 110 may be substantially simultaneously and/or concurrently activated or deactivated by rotation and/or angular displacement of the second switching barrel 122, which is coupled to the selector shaft 62 and the selector knob 60. This, in turn, electrically couples the one or more power sources (e.g., batteries) to, or electrically uncouples the one or more power sources from, the notification panel 26 (e.g., the two power sources coupled to each row 136 of the second electrical switches 110).

As shown in FIGS. 4 and 5, one or more of the first electrical switches 108 and/or one or more of the second electrical switches 110 may include connections 138 configured to be coupled, respectively, to the electrical leads of the one or more sensors 20 and/or the one or more power sources, for example, as explained in more detail herein. In some examples, one or more of the first electrical switches 108 and/or one or more of the second electrical switches 110 may include followers 140 configured to be engaged and disengaged, respectively, by the first switching barrel 120 and the second switching barrel 122, for example, as explained in more detail herein. For example, engagement and disengagement of the followers 140 acts to cause contacts in the first electrical switches 108 and/or the second electrical switches 110 to respectively electrically couple the one or more sensors 20 to, and electrically uncouple the one or more sensors 20 from, the engagement panel 26, and/or to electrically couple the one or more power sources to, and electrically uncouple the one or more power sources from, the notification cabinet 24.

FIG. 6 shows an example of a first switching barrel 120. The first switching barrel 120 may have a length L in a direction parallel to a longitudinal axis X The length L may be tailored to substantially correspond to a space occupied by a number of the first electrical switches 108 aligned adjacent one another in the switching assembly 46. For example, if the switching assembly 46 includes one or two rows 134 of three adjacent first electrical switches 108, the length L may substantially correspond to the space occupied by three adjacent first electrical switches 108. Alternatively, or in addition, if the switching assembly 46 includes one or two rows 134 of four adjacent first electrical switches 108, the length L may substantially correspond to the space occupied by four adjacent first electrical switches 108, for example, resulting in the length L being longer than for a switching assembly 46 having three adjacent first electrical switches 108. This, in some examples, may add scalability (or modularity) to the switching assembly 46, for example, by creating a first switching barrel 120 that has a length L that corresponds to the space occupied by the row 134 of adjacent first electrical switches 108.

As shown in FIG. 6, the example first switching barrel 120 has a substantially oval-shaped cross-section 142 perpendicular to the longitudinal axis X, and a bore 144 sized to receive the selector shaft 62 therethrough (see FIG. 3). The example shown also includes a threaded hole 146 configured to receive the setscrew 124 (see FIG. 3) for coupling the first switching barrel 120 to the selector shaft 62 via engagement between the set screw 124, the first switching barrel 120, and the selector shaft 62.

The example first switching barrel 120 shown in FIG. 6 also includes an opposing pair of longitudinal recesses 148 extending longitudinally at least partially (e.g., fully) the length L of the first switching barrel 120 and substantially parallel to the longitudinal axis X of the first switching barrel 120. In the example shown, each of the longitudinal recesses 148 is located at opposing ends of the oval shape of the cross-section 142 of the first switching barrel 120. As explained with respect to FIGS. 7A-9C, for example, the longitudinal recesses 148 may be configured to engage the followers 140 of the first electrical switches 108.

In some examples, the second switching barrel 122 may have a configuration at least similar to the configuration of the first switching barrel 120. For example, the second switching barrel 122 may have a length in a direction parallel to its longitudinal axis. The length of the second switching barrel 122 may be tailored to substantially correspond to the space occupied by a number of the second electrical switches 110 aligned adjacent one another in the switching assembly 46. For example, if the switching assembly 46 includes one or two rows 136 of two adjacent second electrical switches 110, the length may substantially correspond to the space occupied by two adjacent second electrical switches 110. Alternatively, or in addition, if the switching assembly 46 includes one or two rows 136 of three adjacent second electrical switches 110, the length may substantially correspond to the space occupied by three adjacent second electrical switches 110, for example, resulting in the length being longer than for a switching assembly 46 having two adjacent second electrical switches 110. This, in some examples, may add scalability (or modularity) to the switching assembly 46, for example, by creating a second switching barrel 122 that has a length that corresponds to the space occupied by the row 136 of adjacent second electrical switches 110.

Figure 7A:
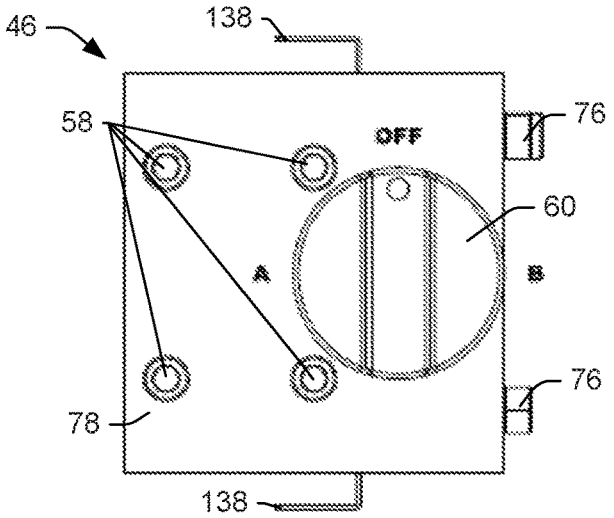
FIG. 7A is a schematic front view of the example switch assembly of FIG. 5 in a first condition.
Figure 7B:
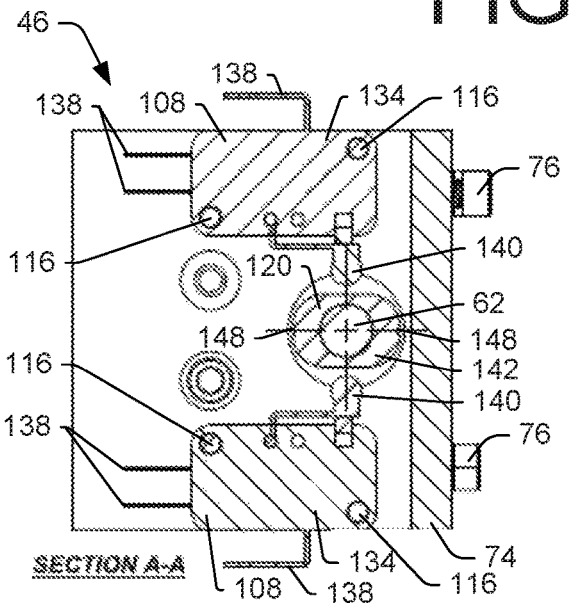
FIG. 7B is a schematic front section view taken along line A-A of FIG. 5 showing an example first switching barrel cross-section with respect to example first electrical switches, with the switch assembly in the first condition.
Figure 7C:
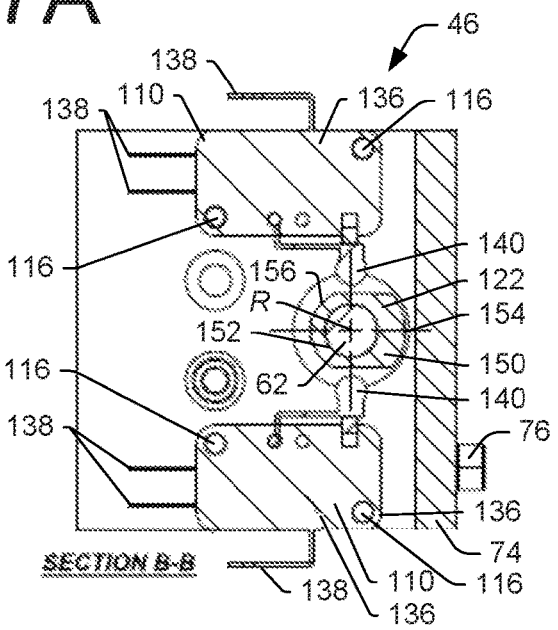
FIG. 7C is a schematic front section view taken along line B-B of FIG. 5 showing an example second switching barrel cross-section with respect to example second electrical switches, with the switch assembly in the first condition.
Figure 8A:
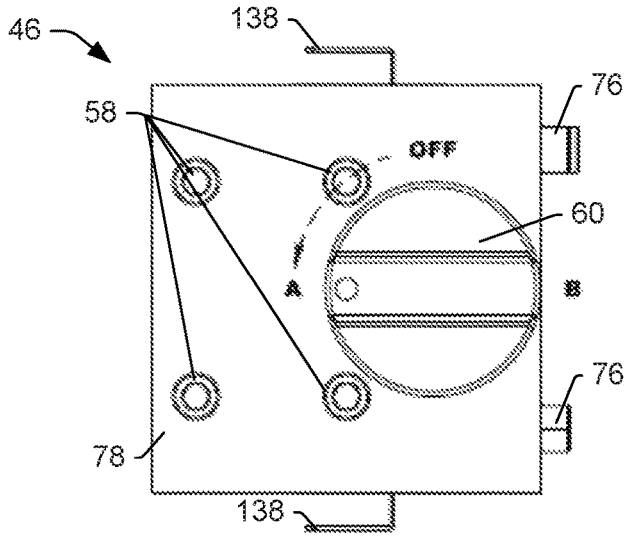
FIG. 8A is a schematic front view of the example switch assembly of FIG. 5 in a second condition.
Figure 8B:
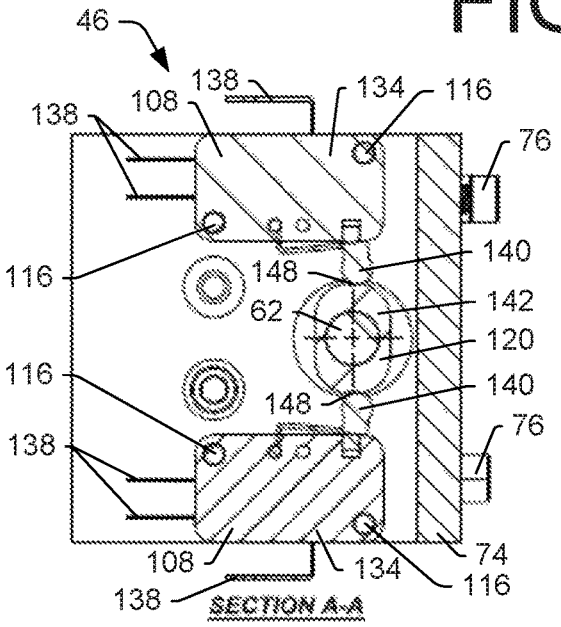
FIG. 8B is a schematic front section view taken along line A-A of FIG. 5 showing the example first switching barrel cross-section with respect to the example first electrical switches, with the switch assembly in the second condition.
Figure 8C:
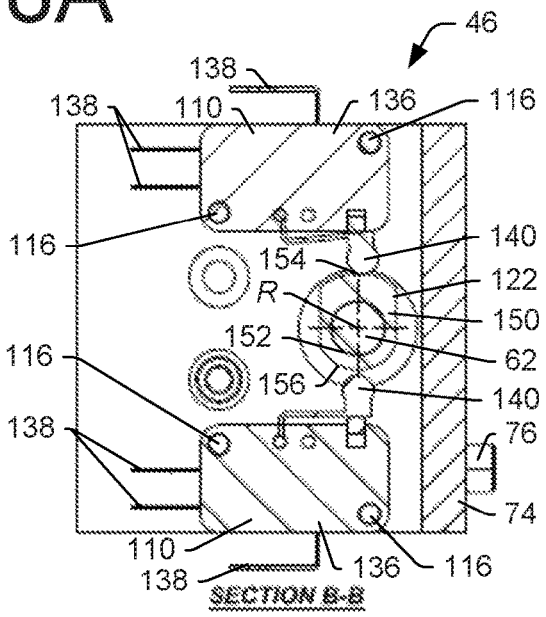
FIG. 8C is a schematic front section view taken along line B-B of FIG. 5 showing the example second switching barrel cross-section with respect to the example second electrical switches, with the switch assembly in the second condition.
Figure 9A:
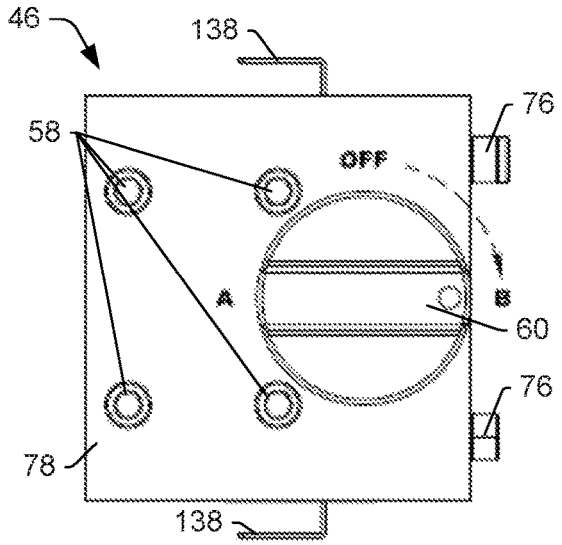
FIG. 9A is a schematic front view of the example switch assembly of FIG. 5 in a third condition.
Figure 9B:
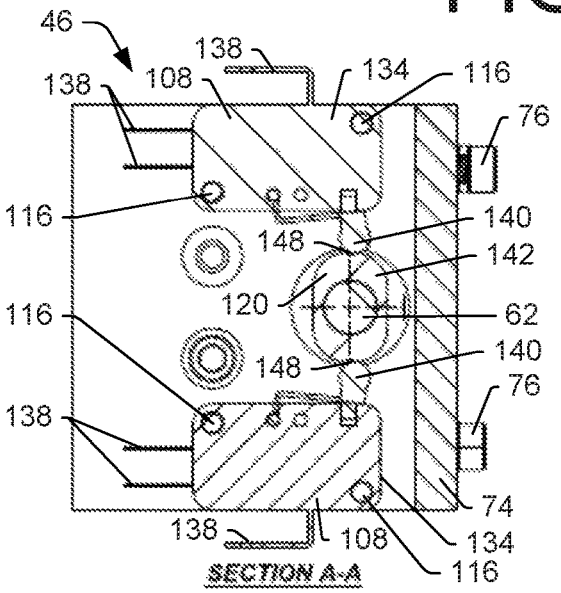
FIG. 9B is a schematic front section view taken along line A-A of FIG. 5 showing the example first switching barrel cross-section with respect to the example first electrical switches, with the switch assembly in the third condition.
Figure 9C:
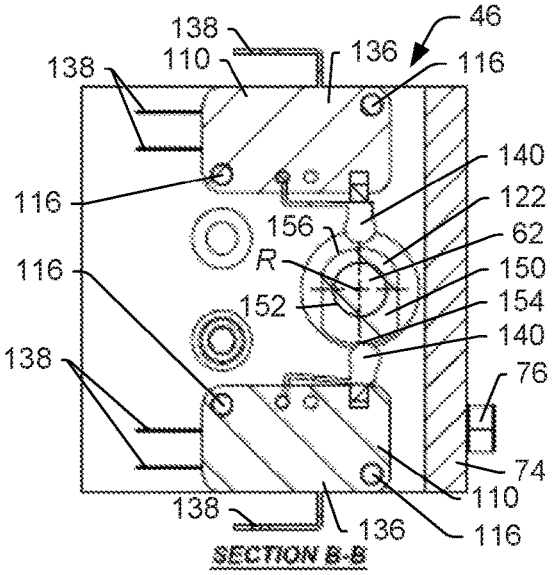
FIG. 9C is a schematic front section view taken along line B-B of FIG. 5 showing the example second switching barrel cross-section with respect to the example second electrical switches, with the switch assembly in the third condition.

Referring to FIGS. 7A, 7B, 7C, 8A, 8B, 8C, 9A, 9B, and 9C, in some examples, the second switching barrel 122 may have a cross-section 150 perpendicular to its longitudinal axis that is different than the cross-section 142 of the first switching barrel 120. For example, as shown in FIG. 6, the cross-section 142 of the first switching barrel 120 may have bi-lateral symmetry with respect to an axis Y, extending perpendicular with respect to the longitudinal axis X and an axis Z extending perpendicular with respect to the longitudinal axis X, and between the opposing longitudinal recesses 148. The second switching barrel 122, in some examples, for example, as shown in FIGS. 7C, 8C, and 9C, may have a bore 152 extending its length and through which the selector shaft 62 may extend (see also FIG. 3). In some examples, the second switching barrel 122 may also include a threaded hole extending to the bore 152 and substantially perpendicular with respect to the longitudinal axis of the second switching barrel 122. The threaded hole of the second switching barrel 122, similar to the threaded hole 146 of the first switching barrel 120, may be configured to receive a set screw 124 (see FIG. 3) to couple the second switching barrel 122 to the selector shaft 62.

As shown in FIGS. 7C, 8C, and 9C, some examples of the second switching barrel 122 may lack the bi-lateral symmetry of some examples of the first switching barrel 120. For example, the cross-section 150 of the example second switching barrel 122 includes a single longitudinal recess 154 rather than a pair of opposing longitudinal recesses 148 as in some examples of the first switching barrel 120. In the example shown, the second switching barrel 120, opposite the longitudinal recess 154, defines a surface 156 (e.g., a semi-cylindrical surface) rotatable to face the followers 140 of the second electrical switches 110 and spaced a radial distance from an axis of rotation R to provide clearance between the surface 156 and the followers 140 of the second electrical switches 110, such that as the surface 156 rotates to a position adjacent the followers 140, the surface 156 does not contact the followers 140 or otherwise cause any change in the status of the second electrical switches 110 (e.g., the surface 156 does not cause a change in activation or deactivation of the second electrical switches 110), for example, as explained with respect to FIGS. 7C, 8C, and 9C.

FIG. 7A is a schematic front view of the example switch assembly 46 of FIG. 5 in a first condition. In the example first condition, the switch assembly 46 is in a condition that results in deactivation of the notification cabinet 24, for example, such that the one or more sensors 20 are electrically uncoupled from the notification cabinet 24, the notification panel 26, the visual notification devices 28, and/or the audible notification devices 30. In some examples, even with the switch assembly 46 in the first, or deactivated, condition, the one or more sensors 20 may remain electrically coupled to the remote monitoring facility 48, such that a person and/or computer may monitor the level 22 of the cargo in one or more of the cargo compartments, thus effectively bypassing the notification cabinet 24.

As shown in FIG. 7A, with the switch assembly 46 in the first condition, the selector knob 60 may be oriented to indicate and/or select that the notification cabinet 24 (e.g., and the switch assembly 46) is in the "OFF" condition. FIG. 7B is a schematic front section view taken along line A-A of FIG. 5 showing an example cross-section 142 of an example first switching barrel 120 with respect to example first electrical switches 108, with the switch assembly 46 in the first condition. As shown, with the switching assembly 46 in the first condition, the first switching barrel 120 does not engage any of the followers 140 of the first electrical switches 108, and thus, contacts in the first electrical switches 108 do not allow electrical coupling of the one or more sensors 20 with the notification cabinet 24, the notification panel 26, the visual notification devices 28, and/or the audible notification devices 30. In some examples, even with the first switching barrel 120 in this first orientation, the contacts of one or more of the first electrical switches 108 may serve to electrically couple the one or more sensors 20 to the remote monitoring facility 48, such that a person and/or computer may monitor the level 22 of the cargo in one or more of the cargo compartments, thus effectively bypassing the notification cabinet 24, for example, as explained above with respect to FIG. 7A.

FIG. 7C is a schematic front section view taken along line B-B of FIG. 5 showing an example cross-section 150 of an example second switching barrel 122 with respect to example second electrical switches 110, with the switch assembly 46 in the first condition. As shown in FIG. 7C, with the switch assembly in the first condition, the second switching barrel 122 does not engage any of the followers 140 of the second electrical switches 110, and thus, contacts in the second electrical switches 110 do not allow electrical coupling of the one or more power sources (e.g., Battery A 38 and/or Battery B 40) with the notification cabinet 24, the notification panel 26, the visual notification devices 28, and/or the audible notification devices 30, thus effectively deactivating the notification cabinet 24. This may be desirable, for example, to conserve the level of charge in one or more batteries of the notification cabinet 24.

FIG. 8A is a schematic front view of the example switch assembly 46 of FIG. 5 in a second condition. Relative to the example first condition shown in FIGS. 7A-7C, in the example second condition, the switch assembly 46 is in a condition that results in activation of the notification cabinet 24, for example, such that the one or more sensors 20 are electrically coupled to the notification cabinet 24, the notification panel 26, the visual notification devices 28, and/or the audible notification devices 30. For example, the selector knob 60, coupled to the selector shaft 62 and the first switching barrel 120, as described herein, may be twisted as shown in FIG. 8A, such that the selector shaft 60 and first switching barrel 120 is displaced angularly, so that the first switching barrel 120 engages the followers 40 of the first electrical switches 108, for example, as shown in FIG. 8B, thereby causing the contacts in the first electrical switches 108 to electrically couple the one or more sensors 20 to the notification cabinet 24, the notification panel 26, the visual notification devices 28, and/or the audible notification devices 30. As shown in FIG. 8B, the longitudinal recesses 148 of the first switching barrel 120 may provide seats in which the rows 134 of followers 140 of the first electrical switches 108 may nest, thereby retaining the first switching barrel 120 in the orientation associated with the second condition of the switch assembly 46 until the selector knob 60 is moved to a different orientation to transform the switch assembly 46 to a different condition.

As shown in FIG. 8C, in some examples, when the selector knob 60 is rotated as shown in FIG. 8A, so that the switch assembly 46 is in the second condition, the second switching barrel 122, coupled to the selector shaft 62, is angularly displaced so that a portion of the second switching barrel 122 engages the follower(s) 140 of an upper row 136 of the second electrical switches 110, which causes the contacts of those second electrical switches 110 to electrically couple one or more power sources to the notification cabinet 24, the notification panel 26, the visual notification devices 28, and/or the audible notification devices 30, for example, upon sensor signals generated by the one or more sensors 20 being received by the first electrical switches 108. This, in turn, facilitates activation of one or more of the visual notification devices 128 or the audible notification devices 130, depending on, for example, the sensor signals received (or not) from the one or more sensors 20. In the example shown, the longitudinal recess 154 of the second switching barrel 122 may provide a seat in which the upper row 136 of followers 140 of the second electrical switches 110 may nest, thereby retaining the second switching barrel 122 in the orientation associated with the second condition of the switch assembly 46 until the selector knob 60 is moved to a different orientation to transform the switch assembly 46 to a different condition. As shown, the surface 156 of the second switching barrel 122, which is opposite the portion of the second switching barrel 122 that is engaged with the upper row 136 of the followers 140, is spaced from the followers 140 of the lower row 136 of followers 140. In some examples, this may result in Battery B 40 being electrically uncoupled from the notification cabinet 24 until the selector knob 60 is twisted to a different position, for example, as explained with respect to FIGS. 9A-9C.

As shown in FIG. 8A, the selector knob 60 has been twisted to the "A" position, which, in some examples, will result in electrically coupling Battery A 38 to the notification cabinet 24, thereby activating the notification cabinet 24 (e.g., if Battery A 38 has a sufficient level of charge). In some examples, even with the selector knob 60 in the orientation shown in FIG. 8A, the contacts of one or more of the first electrical switches 108 may serve to electrically couple the one or more sensors 20 to the remote monitoring facility 48, such that a person and/or computer may monitor the level 22 of the cargo in one or more of the cargo compartments.

FIGS. 9A-9C show the example switch assembly 46 of FIG. 5 in a third condition, for example, in which the notification cabinet 24 is activated, and the power source for the notification cabinet 24 has been changed, for example, such that a first battery or power source (e.g., Battery A 38) has been electrically uncoupled from the notification cabinet 24, and a second battery or power source (e.g., Battery B 40) has been electrically coupled to the notification cabinet 46. For example, relative to the example first condition shown in FIGS. 7A-7C, in the example third condition, the switch assembly 46 is in a condition that results in activation of the notification cabinet 24, for example, such that the one or more sensors 20 are electrically coupled to the notification cabinet 24, the notification panel 26, the visual notification devices 28, and/or the audible notification devices 30. For example, the selector knob 60, coupled to the selector shaft 62 and the first switching barrel 120, as described herein, may be twisted as shown in FIG. 9A, such that the selector shaft 60 and first switching barrel 120 is displaced angularly, so that the first switching barrel 120 engages the followers 40 of the first electrical switches 108, for example, as shown in FIG. 9B, thereby causing the contacts in the first electrical switches 108 to electrically couple the one or more sensors 20 to the notification cabinet 24, the notification panel 26, the visual notification devices 28, and/or the audible notification devices 30. As shown in FIG. 9B, the longitudinal recesses 148 of the first switching barrel 120 may provide seats in which the rows 134 of followers 140 of the first electrical switches 108 may nest, thereby retaining the first switching barrel 120 in the orientation associated with the third condition of the switch assembly 46 until the selector knob 60 is moved to a different orientation to transform the switch assembly 46 to a different condition.

As shown in FIG. 9C, in some examples, when the selector knob 60 is rotated as shown in FIG. 9A, so that the switch assembly 46 is in the third condition, the second switching barrel 122, coupled to the selector shaft 62, is angularly displaced so that a portion of the second switching barrel 122 engages the follower(s) 140 of a lower row 136 of the second electrical switches 110, which causes the contacts of those second electrical switches 110 to electrically couple one or more power sources to the notification cabinet 24, the notification panel 26, the visual notification devices 28, and/or the audible notification devices 30, for example, upon sensor signals generated by the one or more sensors 20 being received by the first electrical switches 108. This, in turn, facilitates activation of one or more of the visual notification devices 28 or the audible notification devices 30, depending on, for example, the sensor signals received (or not) from the one or more sensors 20. In the example shown, the longitudinal recess 154 of the second switching barrel 122 may provide a seat in which the lower row 136 of followers 140 of the second electrical switches 110 may nest, thereby retaining the second switching barrel 122 in the orientation associated with the third condition of the switch assembly 46 until the selector knob 60 is moved to a different orientation to transform the switch assembly 46 to a different condition. As shown, the surface 156 of the second switching barrel 122, which is opposite the portion of the second switching barrel 122 that is engaged with the lower row 136 of the followers 140, is spaced from the followers 140 of the upper row 136 of followers 140. In some examples, this may result in Battery A 40 being electrically uncoupled from the notification cabinet 24 until the selector knob 60 is twisted to a different position, for example, as explained above with respect to FIGS. 8A-8C.

As shown in FIG. 9A, the selector knob 60 has been twisted to the "B" position, which, in some examples, will result in electrically coupling Battery B 40 to the notification cabinet 24, thereby activating the notification cabinet 24 (e.g., if Battery B 40 has a sufficient level of charge). In some examples, even with the selector knob 60 in the orientation shown in FIG. 9A, the contacts of one or more of the first electrical switches 108 may serve to electrically couple the one or more sensors 20 to the remote monitoring facility 48, such that a person and/or computer may monitor the level 22 of the cargo in one or more of the cargo compartments.

Although the example switch assembly 46 shown in FIGS. 7A-9C is configured to facilitate selection among three conditions (e.g., the first, second, and third conditions) for the purpose of describing example features of the switch assembly 46, it is contemplated that the switch assembly 46 may be configured to facilitate selection from among fewer conditions (e.g., two conditions) or more conditions (e.g., four or more conditions). In some examples, the switch assembly 46 may be configured such that selection among the conditions may be performed automatically, for example, without direct human contact. For example, a stepper motor and/or other rotary device may be used to rotate the selector shaft 62, for example, based on one or more signals received from a controller (e.g., including one or more processors and/or a transmitter) configured to select from among the different switch assembly conditions and transmit one or more signals to the stepper motor and/or other rotary device, such that the selector shaft 62 is rotated to an orientation consistent with the one or more signals. Such examples may facilitate remote, partially-autonomous, and/or fully-autonomous operation of the switch assembly 46.

While aspects of the present disclosure have been particularly shown and described with reference to the embodiments above, it will be understood by those skilled in the art that various additional embodiments may be contemplated by the modification of the disclosed machines, systems, and methods without departing from the spirit and scope of what is disclosed. Such embodiments should be understood to fall within the scope of the present disclosure as determined based upon the claims and any equivalents thereof

What is claimed is:

1. A switch assembly for electrically coupling a first electrical device to, and electrically uncoupling the first electrical device from, a second electrical device, the switch assembly comprising:

a first switch configured to electrically couple the first electrical device to, and electrically uncouple the first electrical device from, the second electrical device;

a first switching barrel associated with the first switch and configured to cause the first switch to electrically couple the first electrical device to, and electrically uncouple the first electrical device from, the second electrical device;

a second switch configured to electrically couple a power source to, and electrically uncouple the power source from, the second electrical device;

a second switching barrel associated with the second switch and configured to cause the second switch to electrically couple the power source to, and electrically uncouple the power source from, the second electrical device;

an isolator barrier separating the first switch and the first switching barrel from the second switch and the second switching barrel; and a shaft associated with the first switching barrel and associated with the second switching barrel, such that rotation of the shaft causes:

angular displacement of the first switching barrel and the second switching barrel;

one of electrically coupling the first electrical device to the second electrical device or electrically uncoupling the first electrical device from the second electrical device; and one of electrically coupling the power source to the second electrical device or electrically uncoupling the power source from the second electrical device.

2. The switch assembly of claim 1, wherein at least one of the first switch, the first switching barrel, or the isolator barrier at least partially provide an intrinsically-safe electrical connection between the first electrical device and the second electrical device.

3. The switch assembly of claim 1, wherein at least one of the first switch or the second switch comprises a microswitch.

4. The switch assembly of claim 1, wherein the first switch, upon electrically uncoupling the first electrical device from the second electrical device, is configured to electrically couple the first electrical device to a remotely-located second electrical device.

5. The switch assembly of claim 1, wherein the switch assembly further comprises a third switch adjacent the first switch and configured to electrically couple a third electrical device to, and electrically uncouple the third electrical device from, the second electrical device, and wherein the first switching barrel is configured to cause:

the first switch to electrically couple the first electrical device to, and electrically uncouple the first electrical device from, the second electrical device; and the third switch to electrically couple the third electrical device to, and electrically uncouple the third electrical device from, the second electrical device.

6. The switch assembly of claim 1, wherein the switch assembly further comprises a third switch, the third switch opposite the first switch relative to the shaft and configured to electrically couple a third electrical device to, and electrically uncouple the third electrical device from, the second electrical device, and wherein the first switching barrel is configured to cause:

the first switch to electrically couple the first electrical device to, and electrically uncouple the first electrical device from, the second electrical device; and the third switch to electrically couple the third electrical device to, and electrically uncouple the third electrical device from, the second electrical device.

7. The switch assembly of claim 6, wherein the first switching barrel comprises:

a first cam surface configured to cause the first switch to electrically couple the first electrical device to, and electrically uncouple the first electrical device from, the second electrical device, and a second cam surface circumferentially-spaced from the first cam surface and configured to cause the third switch to electrically couple the third electrical device to, and electrically uncouple the third electrical device from, the second electrical device.

8. The switch assembly of claim 1, further comprising a third switch adjacent the second switch and configured to electrically couple the power source to, and electrically uncouple the power source from, the second electrical device, and wherein the second switching barrel is configured to cause:

the second switch to electrically couple the power source to, and electrically uncouple the power source from, the second electrical device; and the third switch to electrically couple the power source to, and electrically uncouple the power source from, the second electrical device.

9. The switch assembly of claim 1, further comprising a third switch, the third switch opposite the second switch relative to the shaft and configured to electrically couple the power source to, and electrically uncouple the power source from, the second electrical device, and wherein the second switching barrel is configured to cause:

the second switch to electrically couple the power source to, and electrically uncouple the power source from, the second electrical device; and the third switch to electrically couple the power source to, and electrically uncouple the power source from, the second electrical device.

10. The switch assembly of claim 1, wherein the isolator barrier extends substantially perpendicular to the shaft.

11. The switch assembly of claim 1, wherein the shaft comprises fiber reinforced polymer.

12. The switch assembly of claim 1, wherein at least one of the first switching barrel or the second switching barrel comprises a cam surface configured to cause at least one of:

the first switch to electrically couple the first electrical device to, and electrically uncouple the first electrical device from, the second electrical device, or the second switch to electrically couple the power source to, and electrically uncouple the power source from, the second electrical device.

13. A notification cabinet comprising:

an enclosure defining an interior volume;

a notification panel associated with the enclosure and configured to provide at least one of a visual notification or an audible notification; and a switch assembly for electrically coupling a sensor to, and electrically uncoupling the sensor from, the notification panel, the switch assembly comprising:

a first switch configured to electrically couple the sensor to, and electrically uncouple the sensor from, the notification panel;

a first switching barrel associated with the first switch and configured to cause the first switch to electrically couple the sensor to, and electrically uncouple the sensor from, the notification panel;

a second switch configured to electrically couple a power source to, and electrically uncouple the power source from, the notification panel;

a second switching barrel associated with the second switch and configured to cause the second switch to electrically couple the power source to, and electrically uncouple the power source from, the notification panel;

an isolator barrier separating the first switch and the first switching barrel from the second switch and the second switching barrel; and a shaft associated with the first switching barrel and associated with the second switching barrel, such that rotation of the shaft causes:

angular displacement of the first switching barrel and the second switching barrel;

one of electrically coupling the sensor to the notification panel or electrically uncoupling the sensor from the notification panel; and one of electrically coupling the power source to the notification panel or electrically uncoupling the power source from the notification panel.

14. The notification cabinet of claim 13, wherein at least one of the first switch, the first switching barrel, or the isolator barrier at least partially provide an intrinsically safe electrical connection between the sensor and the notification panel.

15. The notification cabinet of claim 13, wherein the first switch, upon electrically uncoupling the sensor from the notification panel, is configured to electrically couple the sensor to a remotely-located notification panel.

16. A notification system for providing at least one of a visual notification associated with a level of cargo in a cargo compartment or an audible notification associated with the level of the cargo in the cargo compartment, the notification system comprising:

a sensor configured to generate a signal indicative of a level of cargo in a cargo compartment;

a notification panel configured to provide at least one of a visual notification or an audible notification; and a switch assembly for electrically coupling the sensor to, and electrically uncoupling the sensor from, the notification panel, the switch assembly comprising:

a first switch configured to electrically couple the sensor to, and electrically uncouple the sensor from, the notification panel;

a first switching barrel associated with the first switch and configured to cause the first switch to electrically couple the sensor to, and electrically uncouple the sensor from, the notification panel;

a second switch configured to electrically couple a power source to, and electrically uncouple the power source from, the notification panel;

a second switching barrel associated with the second switch and configured to cause the second switch to electrically couple the power source to, and electrically uncouple the power source from, the notification panel;

an isolator barrier separating the first switch and the first switching barrel from the second switch and the second switching barrel; and a shaft associated with the first switching barrel and associated with the second switching barrel, such that rotation of the shaft causes:

angular displacement of the first switching barrel and the second switching barrel;

one of electrically coupling the sensor to the notification panel or electrically uncoupling the sensor from the notification panel; and one of electrically coupling the power source to the notification panel or electrically uncoupling the power source from the notification panel.

17. The notification system of claim 16, wherein the sensor comprises an intrinsically safe reed switch.

18. The notification system of claim 16, wherein the power source comprises a battery.

19. The notification system of claim 16, wherein at least one of the first switch, the first switching barrel, or the isolator barrier at least partially provide an intrinsically safe electrical connection between the sensor and the notification panel.

20. The notification system of claim 16, wherein the first switch, upon electrically uncoupling the sensor from the notification panel, is configured to electrically couple the sensor to a remotely-located notification panel.

* * * * *